US006481043B2

(12) United States Patent
Anderson et al.

(10) Patent No.: US 6,481,043 B2
(45) Date of Patent: Nov. 19, 2002

(54) ROTARY BRUSH ATTACHMENT TOOL FOR A HAND-HELD VACUUM CLEANER

(75) Inventors: Troy G. Anderson, Marblehead, MA (US); Rudy A. Vandenbelt, Ottawa (CA)

(73) Assignee: Headwaters Research & Development, Inc, Ottawa (CA)

( * ) Notice: Subject to any disclaimer, the term of this patent is extended or adjusted under 35 U.S.C. 154(b) by 0 days.

(21) Appl. No.: 09/878,659

(22) Filed: Jun. 11, 2001

(65) Prior Publication Data

US 2002/0013977 A1 Feb. 7, 2002

Related U.S. Application Data

(60) Provisional application No. 60/211,060, filed on Jun. 13, 2000.

(51) Int. Cl.[7] ..... A47L 5/26

(52) U.S. Cl. ..... 15/246.2; 15/328; 15/344

(58) Field of Search ..... 15/246.2, 328, 15/338, 344, 383, 388

(56) References Cited

U.S. PATENT DOCUMENTS 1,119,393 A * 12/1914 Binkley
1,209,722 A * 12/1916 Kirby
4,920,606 A * 5/1990 Gerke, Jr. et al.
4,928,346 A * 5/1990 Elson et al.
5,379,483 A * 1/1995 Pino
5,410,775 A * 5/1995 Frazier

* cited by examiner

*Primary Examiner*—Terrence R. Till
(74) *Attorney, Agent, or Firm*—Albert Peter Durigon

(57) ABSTRACT

A rotary brush attachment tool for a hand-held vacuum cleaner having a dust bowl terminating in a nozzle end provides a mechanical force that acts to move foreign matter into the attachment tool from which the foreign matter is drawn into the nozzle end of the dust bowl of the hand-held vacuum cleaner to which it is removably attached.

2 Claims, 3 Drawing Sheets

ROTARY BRUSH ATTACHMENT TOOL FOR A HAND-HELD VACUUM CLEANER

This application claims the benefit of provisional application No. 60/211,060 filed Jun. 13, 2000.

FIELD OF THE INVENTION

This invention is drawn to the field of brushing, scrubbing and general cleaning, and more particularly, to a novel rotary brush attachment tool for a hand-held vacuum cleaner.

BACKGROUND OF THE INVENTION

Hand-held vacuum cleaners are well-known devices generally useful about the home, office and other locations to provide pick-up of dirt and/or liquid spillage. The devices typically include a powered unit (corded or cordless) to which a dust bowl is removably attached, and a filter and liquid separator for collecting dirt and or liquids within the dust bowl. U.S. Pat. No. 4,831,685 issued May 23, 1989 to Bosyjl et al., incorporated herein by reference, is exemplary of the heretofore known wet/dry hand-held vacuum cleaners.

While hand-held vacuum cleaners prove acceptable to pick-up smaller solids and/or liquid spillage from floors and other smooth surfaces, their pick-up utility is limited by the character of the foreign matter to be cleaned and/or the nature of the underlying surface. The heavier or more clinging (e.g., fabric thread, pet hair) the foreign matter and the more porous or irregular the underlying surface the more difficult is the pick-up.

There is thus a need for an attachment tool for a hand-held vacuum cleaner that assists in pick-up of dirt, pet hair, liquid and the like whenever the character of the foreign matter and/or the nature of the underlying surface would otherwise result in ineffective or less than effective removal of foreign matter.

SUMMARY OF THE INVENTION

Accordingly, it is the general object of the present invention to disclose an attachment tool for a hand-held vacuum cleaner having a dust bowl terminating in a nozzle end that is removably attachable to the dust bowl and in fluid communication with the nozzle end and provides a mechanical force that acts to move foreign matter into the attachment tool from which the foreign matter is drawn into the nozzle end of the dust bowl of the hand-held vacuum cleaner to which it is removably attached.

In accordance therewith, the disclosed rotary brush attachment tool for a hand-held vacuum cleaner of the present invention includes a housing member elongated between first and second ends that provides a flow passageway therebetween, with the first end adapted to mount to the dust bowl of the hand-held vacuum cleaner and with the second end having a spillage pick-up window; a generally cylindrical brush having an axle rotatably mounted to the housing member in the flow passageway between said first and second ends thereof in such a way that said generally cylindrical brush partially extends out the open spillage pick-up window; and means for turning the generally cylindrical brush to mechanically move foreign matter into the passageway of the housing of the rotary brush attachment tool.

In the presently preferred employments, the turning means includes at least one roller member mounted for rotation with the axle of the generally cylindrical brush that responds to the normal back-and-forth cleaning motion of the hand-held vacuum cleaner to rotate said generally cylindrical brush.

BRIEF DESCRIPTION OF DRAWINGS

These and other objects, inventive aspects and advantageous features of the present invention will become apparent as the invention becomes better understood by referring to the following slowly exemplary detailed description of the presently preferred embodiments thereof, and to the drawings, wherein.

DETAILED DESCRIPTION OF THE PRESENTLY PREFERRED EMBODIMENTS

Figure 1:
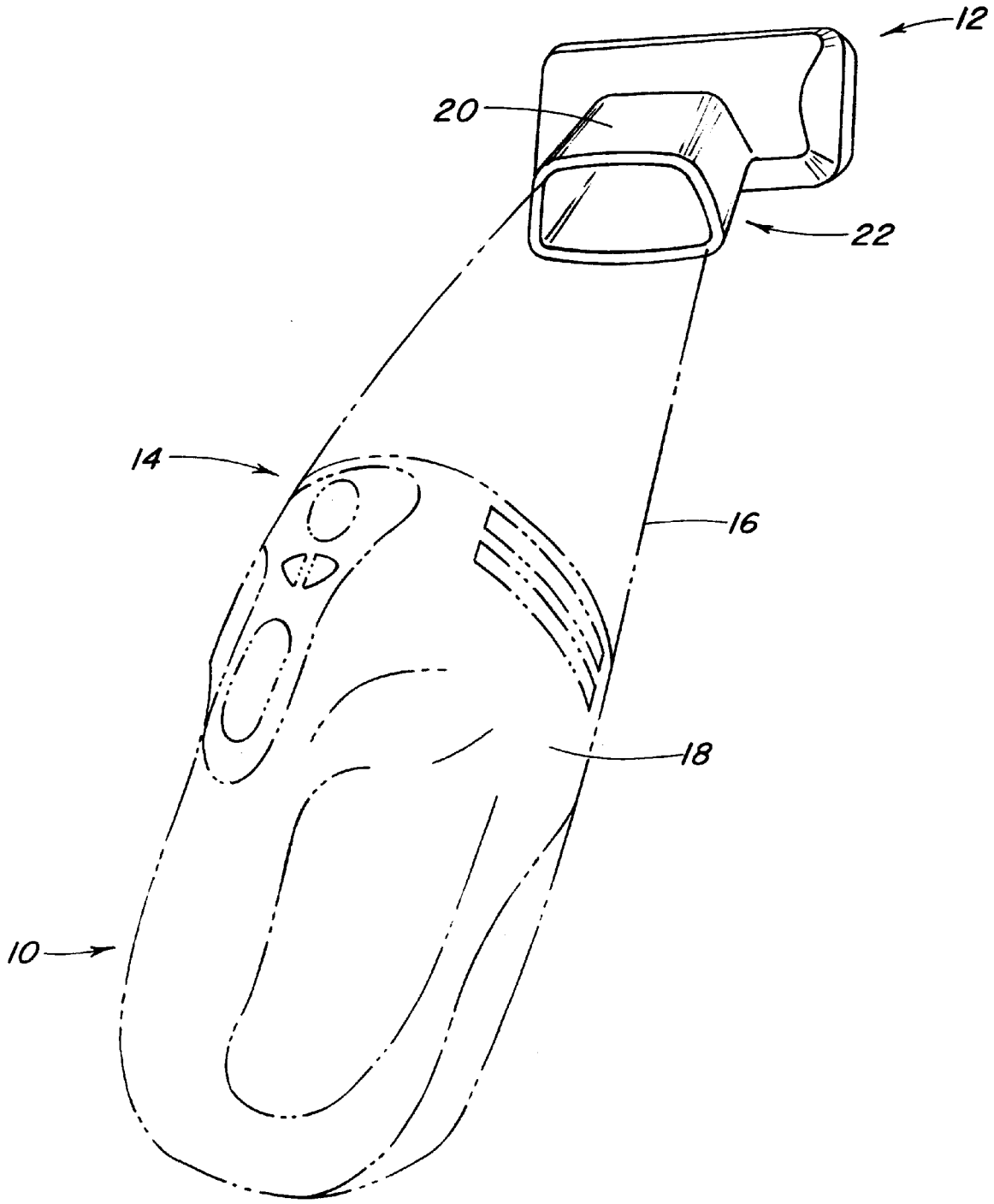
FIG. 1 is a top and end perspective view of the novel rotary brush attachment tool for a hand-held vacuum cleaner of the present invention illustrating the hand-held vacuum cleaner to which it is attached in dashed outline.

Referring now to FIG. 1, generally designated at 10 is a top and end perspective view illustrating the rotary brush attachment tool for a hand-held vacuum cleaner in accord with the present invention. Rotary brush attachment tool generally designated 12 is releasably mounted to a hand-held vacuum cleaner generally designated 14 illustrated in dashed outline. The hand-held vacuum cleaner 14 includes a dust bowl 16 removably attached to a powered unit 18. The rotary brush attachment tool 12 provides a mechanical force that moves otherwise troublesome foreign matter into the dust bowl 16 of the hand-held vacuum cleaner 14. In the presently preferred embodiments, a rotary brush to be described actuated by the back-and-forth motion of the hand-held vacuum cleaner is employed, although other brush or other structures that could be actuated electrically or otherwise may be employed without departing from the inventive concepts.

The rotary brush attachment tool 12 of the present invention includes a generally cup-shaped attachment end 20 adapted to frictionally-fit onto the dust bowl 16 over the nozzle end generally designated 22 of the illustrated hand-held vacuum cleaner 14, although any suitable means for releasably mounting the attachment tool 12 to the dust bowl 16 of any intended hand-held vacuum cleaner such that it is in fluid-tight communication with the nozzle and is mechanically stable may be employed.

Figure 2:
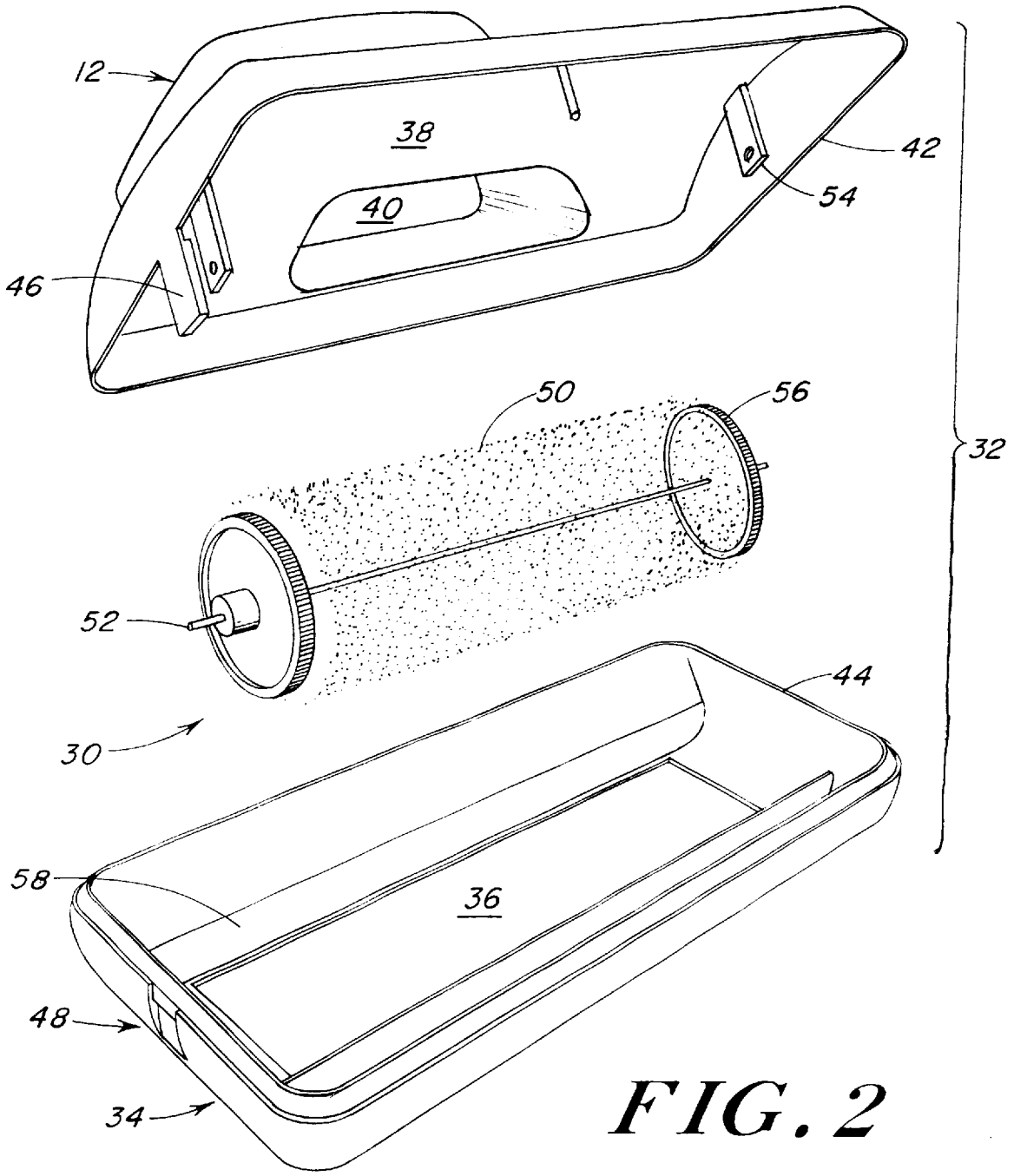
FIG. 2 is an exploded perspective view of one embodiment of a rotary brush attachment tool for a hand-held vacuum cleaner of the present invention.

Referring now to FIG. 2, generally designated at 30 is an exploded perspective view of one presently preferred embodiment of the rotary brush attachment tool for a hand-held vacuum cleaner of the present invention. The attachment tool 30 includes a housing designated by bracket 32 elongated between its dust bowl attachment end 12 and a spillage pick-up end generally designated 34. The spillage pick-up end 34 is provided with an open, generally-rectangular, spillage pick-up window generally designated 36. A flow passageway generally designated 38 is defined between the dust bowl attachment end 12 and the spillage pick-up end 34. The attachment end 12 is in fluid communication with the flow passageway 38 of the housing 32 via duct generally designated 40, and the spillage pick-up end 34 is in fluid communication therewith via the spillage pick-up window 36. The housing 32 includes interfitting top and bottom housing members 42, 44 that releasably snap-lock together, a cooperative tongue 46 and recess generally designated 48 being provided therefor respectively on the top and bottom housing members 42, 44, although any other housing construction or releasable securing means could be employed.

An elongated, generally-cylindrical brush 50 having an axle 52 is rotatably mounted to the housing 32 in the flow passageway 38 between the dust bowl attachment end 12 and spillage pick-up end 34 such that a portion of the brush 50 extends through the spillage pick-up window 36. Preferably, the axle 52 is mounted for rotation in bearing races provided therefor on struts 54 integrally formed with top housing member 42 of the housing 32, although any other rotatable mounting arrangement could be employed.

Rollers 56 are mounted for rotation with the axle 52 of the brush 50 that are adapted to extend into the spillage pick-up window 36, although any other means for turning the brush 50 may be employed. The lateral edges 58 of the spillage pick-up window 36 preferably are beveled inwardly to facilitate passage of foreign matter through the window 36 of the spillage pick-up end 34 of the housing 32 into the flow passageway 38.

In operation, with the back-and-forth motion normally employed to pick up dirt and/or liquid spillage, the rollers 56 turn the brush 50 about the axle 52 captured in the bearing races of struts 54. The turning of the brush 50 imparts a mechanical force to foreign matter in the spillage pick-up window 36 of the pick-up end 34, which acts to move the same into the flow passageway 38 of the housing 32 of the attachment tool 30, from which it is drawn into the nozzle end 22 (FIG. 1) of the hand-held vacuum cleaner 14 (FIG. 1).

Figure 3:
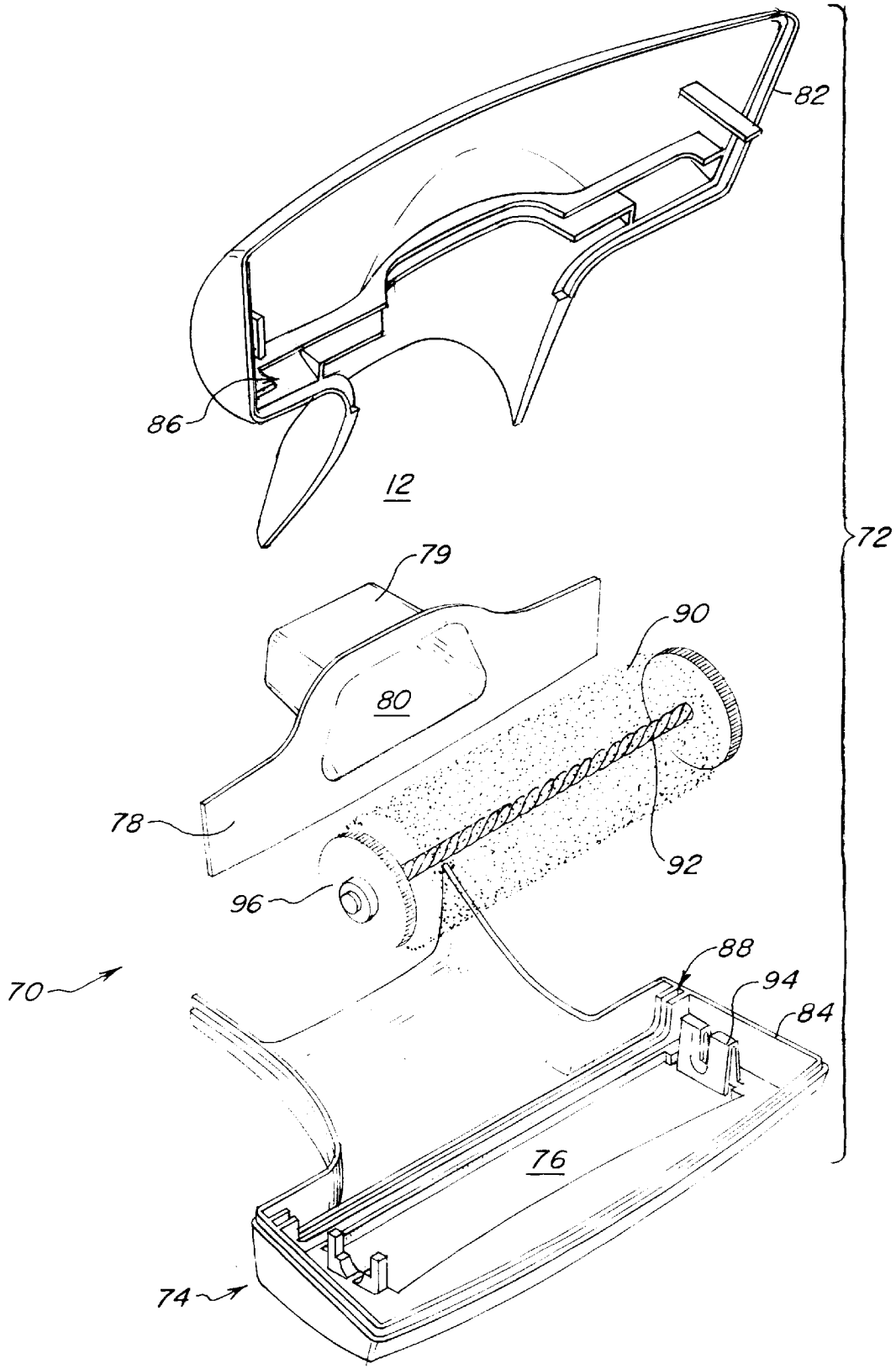
FIG. 3 is an exploded perspective view of another embodiment of a rotary brush attachment tool for a hand-held vacuum cleaner of the present invention.

Referring now to FIG. 3, generally designated at 70 is an exploded perspective view of another presently preferred embodiment of the rotary brush attachment tool for a hand-held vacuum cleaner of the present invention. The attachment tool 70 includes a housing designated by bracket 72 elongated between its dust bowl attachment end 12 and a spillage pick-up end generally designated 74. The spillage pick-up end 74 is provided with an open, generally-rectangular, spillage pick-up window generally designated 76. A baffle 78 having a nose 79 adapted to friction-fit into the nozzle end 22 (FIG. 1) that defines a flow passageway generally designated 80 is mounted in the housing 72, with the nose 79 concentric with the attachment end 12 and with passageway 80 thereof in fluid communication with the window 76 of the spillage pick-up end 74 of the rotary brush attachment tool 70.

The housing 72 includes interfitting top and bottom housing members 82, 84, within which the baffle 78 is captured and held in confronting grooves generally designated 86, 88 provided therefor on the inside of the top and bottom housing members 82, 84. The interfitting top and bottom housing members 82, 84 are threadably fastened together, although any other housing construction, baffle securing arrangement or releasable securing means could be employed.

An elongated, generally-cylindrical brush 90 having an axle 92 is rotatably mounted to the housing 72 between the dust bowl attachment end 12 and spillage pick-up end 74 such that it faces the passageway 80 with a portion of the brush 90 extending through the spillage pick-up window 76. Preferably, the axle 92 is mounted for rotation in bearing races provided therefor on struts 94 integrally formed with the bottom housing member 84 of the housing 72, although any other rotatable mounting arrangement could be employed.

Rollers 96 are mounted for rotation with the axle 92 of the brush 90 that are adapted to extend into the spillage pick-up window 76, although any other means for turning the brush 90 may be employed.

In operation, with the back-and-forth motion normally employed to pick up dirt and/or liquid spillage, the rollers 96 turn the brush 90 about the axle 92 captured in the bearing races of struts 94. The turning of the brush 90 imparts a mechanical force to foreign matter in the spillage pick-up window 76 of the pick-up end 74, which acts to move the same into the flow passageway 80 of the baffle 78, from which it is drawn into the nozzle end 22 (FIG. 1) of the hand-held vacuum cleaner 14 (FIG. 1).

Many modifications of the presently disclosed invention will become apparent to those of skill in the art having benefitted from the instant disclosure.

What is claimed is:

1. A rotary brush attachment tool for a hand-held vacuum cleaner having a dust bowl terminating in a nozzle end, comprising:

a housing member elongated between first and second ends that provides a flow passageway therebetween, with the first end adapted to mount to said dust bowl of said hand-held vacuum cleaner and with the second end having an open spillage pick-up window;

a generally cylindrical brush having an axle rotatably mounted to the housing member in the flow passageway between said first and second ends thereof in such a way that said generally cylindrical brush partially extends out the open spillage pick-up window thereof;

means for turning the generally cylindrical brush to mechanically move foreign matter into the passageway of said housing member;

wherein a baffle having a nose adapted to be inserted into said nozzle end is mounted in said housing member; and wherein the first end is adapted to mount to the dust bowl over the nozzle end of the hand-held vacuum cleaner.

2. A rotary brush attachment tool for a hand-held vacuum cleaner having a dust bowl terminating in a nozzle end, comprising:

a housing member elongated between first and second ends that provides a flow passageway therebetween, with the first end adapted to mount to said dust bowl of said hand-held vacuum cleaner and with the second end having an open spillage pick-up window;

a generally cylindrical brush having an axle rotatably mounted to the housing member in the flow passageway between said first and second ends thereof in such a way that said generally cylindrical brush partially extends out the open spillage pick-up window thereof;

means for turning the generally cylindrical brush to mechanically move foreign matter into the passageway of said housing member;

wherein said turning means includes a roller mounted for rotation with said axle of said generally cylindrical brush which partially extends out the open spillage pick-up window.

* * * * *